United States Patent [19]

Girman et al.

[11] Patent Number: 4,893,375

[45] Date of Patent: Jan. 16, 1990

[54] DUAL MODE FLOOR SCRUBBING MACHINE

[75] Inventors: Richard L. Girman, Glen Ellyn; Gary E. Palmer, Roselle; Gust G. Gotsis, Naperville; Ralph Weimer, Wheaton, all of Ill.

[73] Assignees: Hako Minuteman, Inc., Addison; Restaurant Technology, Inc., Oak Brook, both of Ill.

[21] Appl. No.: 325,559

[22] Filed: Mar. 17, 1989

[51] Int. Cl.[4] ..... A47L 7/00

[52] U.S. Cl. ..... 15/321; 15/320; 15/322; 15/328; 15/334; 15/417

[58] Field of Search ..... 15/320, 321, 322, 328, 15/334, 335, 417

[56] References Cited

U.S. PATENT DOCUMENTS

| | | | |
|---|---|---|---|
| 2,793,384 | 5/1957 | Ortega | 15/328 |
| 2,867,835 | 1/1959 | Brown et al. | 15/417 X |
| 3,029,461 | 4/1962 | Osborn | 15/417 X |
| 3,079,623 | 3/1963 | Congdon | 15/417 X |
| 4,809,397 | 3/1989 | Jacobs et al. | 15/320 |

FOREIGN PATENT DOCUMENTS

| | | | |
|---|---|---|---|
| 176696 | 4/1986 | European Pat. Off. | 15/322 |
| 2206478 | 1/1989 | United Kingdom | 15/322 |

OTHER PUBLICATIONS

National Super Service Co. Squeegee w/Brush, (2 pages) (date unknown).

Advance Convertible Brush/Vacuum Pick-Up with Spray Nozzle (3 pages) (date unknown).

Hako brochure "Superior Technique for Industrial Cleaning" (date unknown).

Hako Minuteman brochure "Hakomatic B43 and B53 Battery Compact Automatic Scrub" (date unknown).

Hako Minuteman Instruction Manual for Hakomatic B43 (7406) (date unknown).

*Primary Examiner*—Chris K. Moore

*Attorney, Agent, or Firm*—Emrich & Dithmar

[57] ABSTRACT

A portable floor scrubbing machine, which preferably is battery-powered, may operate in two distinct modes: either as a walk-behind floor scrubber or as a manually-operated, scrub-and-recover system using a floor wand having a cleaning solution dispenser and convertible brush/squeegee at the working end of the wand for use in locations with difficult access.

5 Claims, 2 Drawing Sheets

DUAL MODE FLOOR SCRUBBING MACHINE

FIELD OF THE INVENTION

The present invention relates to floor scrubbing machines; and more particularly, it relates to a floor scrubbing machine capable of operating in either of two distinct modes. In the first mode of operation, the machine is a conventional "walk-behind" floor scrubber. In the second mode, which is particularly useful in difficult locations, it may be used as a "scrub-and-recover" machine with a manually-operated floor wand.

BACKGROUND OF THE INVENTION

With the proliferation of fast food restaurants and the extended business hours of these restaurants, a number of problems have arisen in maintaining a desirable level of cleanliness in both public areas and in the work areas of these restaurants.

As a result of the many different problems which have arisen, there is no single machine which can maintain the floors of fast food restaurants clean under all or most of the circumstances encountered.

One of the primary problems encountered by the owner or operator of a fast food restaurant in connection with maintaining clean floors is that the type of machine which may be the most efficient in cleaning a large, open area (e.g., a conventional "walk-behind" floor scrubber) is not capable of reaching and cleaning locations such as those typically found beneath tables or fixed seating, or in crevices. Such hard-to-access places are found even more frequently in the kitchen area of a restaurant, and it would be desirable, obviously, to have a single machine capable of accessing all conditions normally encountered in a modern fast food restaurant including those in the public areas as well as those in the kitchen or cooking areas. No such machine commercially exists today. In fact, one proposed solution is to install vacuum outlets throughout the building, but such a system is expensive and is limited to collecting loose debris. It is not effective in removing grease or other material adhered to the floor.

Another problem encountered by owners or operators of fast food restaurants in connection with maintaining clean floors is that frequently conventional cleaning methods simply do not accomplish the desired effect. For example, many fast food restaurants clean floors in the public areas as well as in the kitchen by using a conventional mop and pail. This permits the operator to use strong detergents to clean the floor, dissolve grease and loosen grime, but it does not permit recovery of the dirt and debris which has been loosened. That is, mops are effective in applying detergent to loosen dirt and debris, but they remove only that material which clings to the surface of the mop. Moreover, it has been found that some inexperienced help when using a mop may actually spread loosened dirt and grime into areas where it did not even exist before such as on the baseboard of walls or the lower sections of seating supports.

A conventional walk-behind floor scrubber overcomes the problem of dirt removal since it has a vacuum recovery system for collecting and removing spent cleaning solution and the dirt and debris that it contains. However, such walk-behind scrubbing machines do not have the ability to access all locations, such as beneath tables, beneath seating or in narrow spaces.

SUMMARY OF THE INVENTION

The present invention involves a machine which may be used in either a walk-behind mode or a manual "scrub and recover" mode. The term "walk-behind" refers to a machine which has support wheels and includes either its own storage batteries or receives power from a conventional wall outlet via an extension cord, and the operator stands behind the machine during operation and walks along with it. The machine may be self-propelled or it may be pushed by the operator.

In the "walk-behind" mode, the present invention operates like a conventional walk-behind floor scrubber. The cleaning solution is dispensed under gravity adjacent a rotary brush located at the base of the machine. The brush works the cleaning solution into the dirt and loosens grime on the floor, and a vacuum recovery system collects and stores the spent (i.e., dirty) solution in the machine so that the machine leaves the floor clean and substantially dry after a single pass. This mode is most useful for large open areas.

In the manual "scrub and recover" mode, the machine remains stationary (or is moved as needed) and acts essentially as a source of power, a source of cleaning fluid and a reservoir for recovering the spent solution. The cleaning fluid is dispensed under pressure through a hand-operated wand which is manipulated by the operator. At the end of the wand, which includes a rigid suction tube, there is a convertible operating head which is moveable between two use positions. In one use position, the operating head includes a brush which works the cleaning solution into the dirt and grime on the floor by hand. After the dirt is loosened, the spent solution, including any debris loosened by the hand operation of the brush is collected through a vacuum squeegee and delivered through the rigid vacuum tube of the wand to the recovery tank in the machine.

Thus, the present invention has the advantage of a conventional walk-behind floor scrubber in that it can efficiently clean large open spaces such as are normally found in fast food restaurants, while removing substantially all loosened dirt and debris. It has the further advantage, however, that it can be used to spray cleaning solution in hard-to-access areas such as beneath seating or beneath tables. The operator may use a scrub brush to work the solution into the dirt and grime, and then simply turn the working head of the wand to the recovery position, and remove substantially all of the cleaning fluid, dirt and grime even in those hard-to-access locations. Again, the use of a vacuum pick-up leaves the floor free of standing water.

Thus, another feature of the invention, not found in many conventional cleaning techniques which do not recover spent solution, such as mops, is that after operation, since most of the spent solution, dirt and grime are removed, the residual liquid is minimal and drying is achieved much more quickly. This reduces the amount of time that an area has to be set aside or warnings place to limit access by the public or employees.

It will thus be appreciated that the present invention provides great flexibility and convenience as well as efficiency and safety in being able to clean an open floor area with a conventional walk-behind design which also uses a vacuum recovery system to collect and store spent solution, but which alternatively provides a manually operated floor wand including a convertible operating head which, in one position, provides a scrub brush for working cleaning solution into the floor and, in the alternate position, provides a vacuum pick-up for recovering spent solution in hard-to-access areas.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
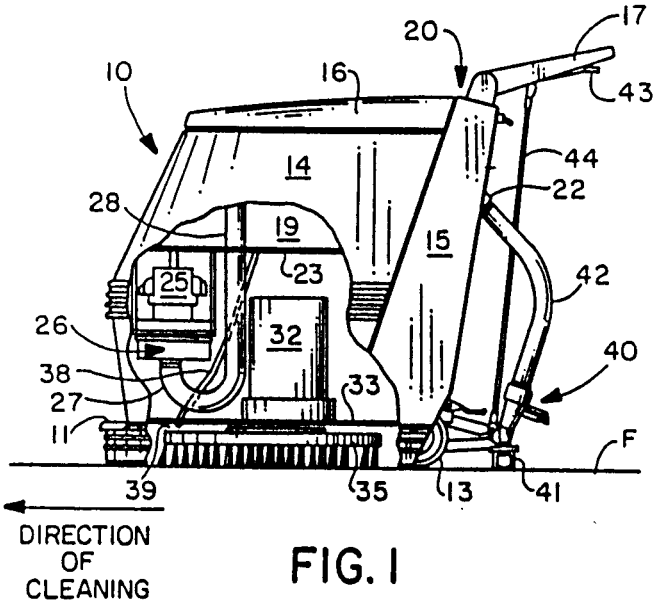
FIG. 1 is a left side elevational view of a walkbehind floor scrubbing machine modified to incorporate the present invention with portions of the cover panel cut away to view the interior with the machine.

Referring first to FIG. 1, reference numeral 10 generally designates a floor scrubbing machine configured for use by an operator walking behind the machine. In FIG. 1, the machine is intended to move to the left, so the operator would be standing to the right as viewed in FIG. 1, and facing toward the left. The machine 10 includes a chassis 11 to which are mounted forward and rear wheels, the left rear wheel being partially visible and designated by reference numeral 13 in FIG. 1.

The machine 10 also includes a cover panel or cowling 14 which covers both sides as well as the front of the machine, a rear panel 15, a lid 16 and an operator's handle 17. Housed within the machine 10 just beneath the lid 16 are two tanks: a cleaning solution tank 18 which stores cleaning solution ready for use, and a recovery tank 19 which stores spent solution (see FIG. 2). Access to the cleaning solution tank 18 and the recovery tank 19 is gained by raising the lid 16 which rotates about a hinge 20 which secures the lid 16 to the top of the rear panel 15, as best seen in FIG. 1. When the lid 16 is lowered, it latches and seals against the upper periphery of the recovery tank 19 so that when a vacuum is induced in the recovery tank 19, that vacuum is transmitted through a tubular extension 22 into the recovery tank 19, as will be described presently.

Figure 2:
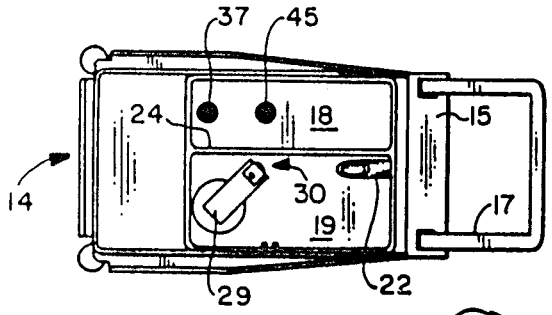
FIG. 2 is a plan view of the machine of FIG. 1 with the lid removed.

A horizontal wall 23 provides the bottom for the tanks 18, 19; and they are separated by a vertical wall 24. Mounted beneath the horizontal wall 23, as best seen in FIG. 1, is a vacuum motor 25 which drives a blower 26. The inlet of the blower 26 is coupled by means of a flexible conduit 27 to a vertical standpipe 28 mounted above the horizontal wall 23. The standpipe 28 is mounted in the recovery tank 19, and at its top, as best seen in FIG. 2, it is provided with a lateral extension 29, at the end of which there is a vacuum shut-off valve generally designated 30.

In operation, when the lid 16 is closed, and the motor 25 is energized, the blower 26 is driven to remove air from within the recovery tank 19, through the shut-off valve 30, the extension 29, the vertical standpipe 28 and the flexible conduit 27, thereby to create a partial vacuum within the recovery tank 19. As indicated, that vacuum is communicated to a recovery pick-up system, to be described, through the tubular extension 22.

If the liquid level in the recovery tank 9 exceeds a predetermined level, then a float in the vacuum shut-off 30 will rise to seal off the inlet aperture to the extension 29 and prevent any further communication of the vacuum generated by blower 26 to the interior of the recovery tank 19 so that the blower 26 is protected against the intake of liquids.

Also mounted beneath the horizontal wall 23 is a brush drive motor 32 which is mounted to a lower horizontal wall 33 forming a part of the chassis or frame of the machine. The drive motor 32 is coupled to a rotary brush 35 to drive it in rotation about a vertical axis to scrub the floor, diagrammatically represented by F.

Cleaning solution stored within the tank 19 travels through primary screen or filter 37 under gravity through conduit 38 to dispenser 39 adjacent the periphery of the scrub brush 35. Thus, cleaning solution is fed under gravity adjacent the brush 35 so that it is worked into the dirt and debris on the floor F by the brush 35.

Spent solution, that is cleaning solution, dirt and debris which has been loosened by the brush 35, is collected by a vacuum recovery system generally designated 40 and including a squeegee pick-up 41 which is connected to a flexible conduit 42, the upper end of which is attached to the rear end of the rigid extension conduit 22 which communicates with the interior of the vacuum tank 19. Thus, when a vacuum is generated within the recovery tank 19, that vacuum is communicated through the tubular extension 22 and flexible conduit 42 to the pick-up 41 to create a suction action to recover spent solution and to deliver it to the recovery tank 19 where it is stored until it is dumped.

The squeegee pick-up device 41 may be raised to an elevated position above the floor by operation of a lever 43 which is connected to the squeegee pick-up 41 by means of cable 44, so that the machine can be transported over a floor without scrubbing the floor.

Figure 4:
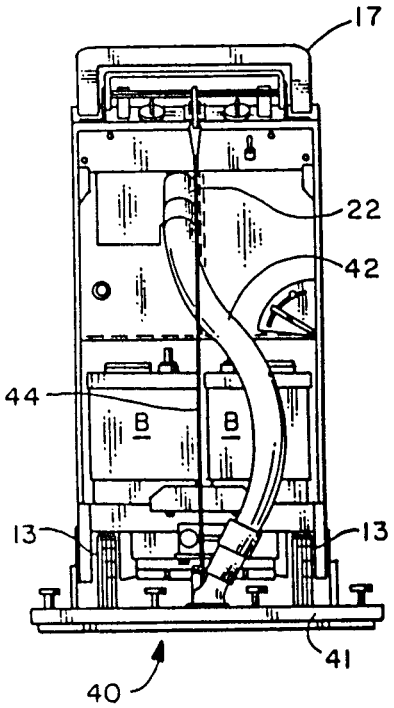
FIG. 4 is a rear view of the inventive machine configured in the "walk-behind" mode.
Figure 5:
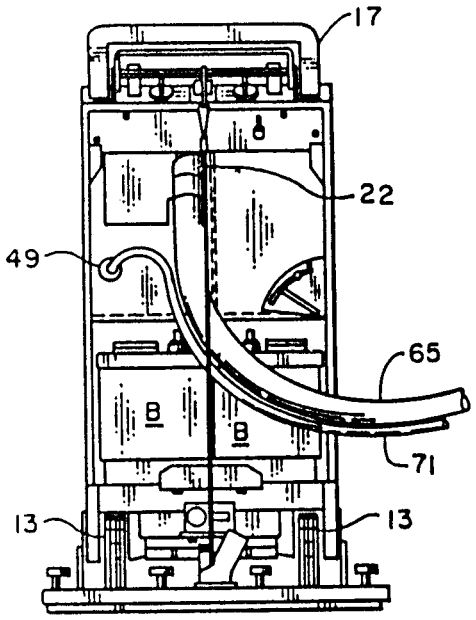
FIG. 5 is a rear view of the inventive machine configured in the manual "scrub and recover" mode.

Vacuum motor 25 and brush drive motor 32 may be energized by storage batteries designated B as best seen in FIGS. 4 and 5. The batteries B are stored on the chassis of the machine and carried by the machine so that the machine is self-sufficient. Alternatively, an extension cord could be used but a long extension cord is inconvenient and creates an unpleasant appearance when strewn across a floor, especially in a fast food restaurant where people are continuously present.

The operation of the machine thus far described is similar to a conventional "walk-behind" portable floor scrubbing machine. One such prior art machine is sold by Hako Minuteman, Inc. of Addison, Ill., the assignee of the present application under the model designation B-43.

The machine thus far described is very useful in cleaning large, open areas, as it may either be pushed by the operator or self-propelled, although in the case of a battery powered machine, there is a desire to save energy and prolong the operation of the machine between battery charges so battery-operated machines ordinarily are not self-propelled.

In order to enhance the usefulness of the machine and enable it to work in areas otherwise hard to access, apparatus is included to permit the machine to operate in a manual "scrub and recover" mode. The accomplish this, a second inlet strainer or filter 45 is provided in the bottom of the solution tank 18 (FIGS. 2 and 3), mounted to the horizontal bottom wall 23 of the solution tank. The bottom of filter 45 is connected by a flexible tube 46 to a dispensing pump 47 which delivers fluid under pressure through a second flexible tube 48. The other end of the tube 48 is attached to a quick disconnect connector 49 mounted to the rear wall of the machine.

Figure 3:
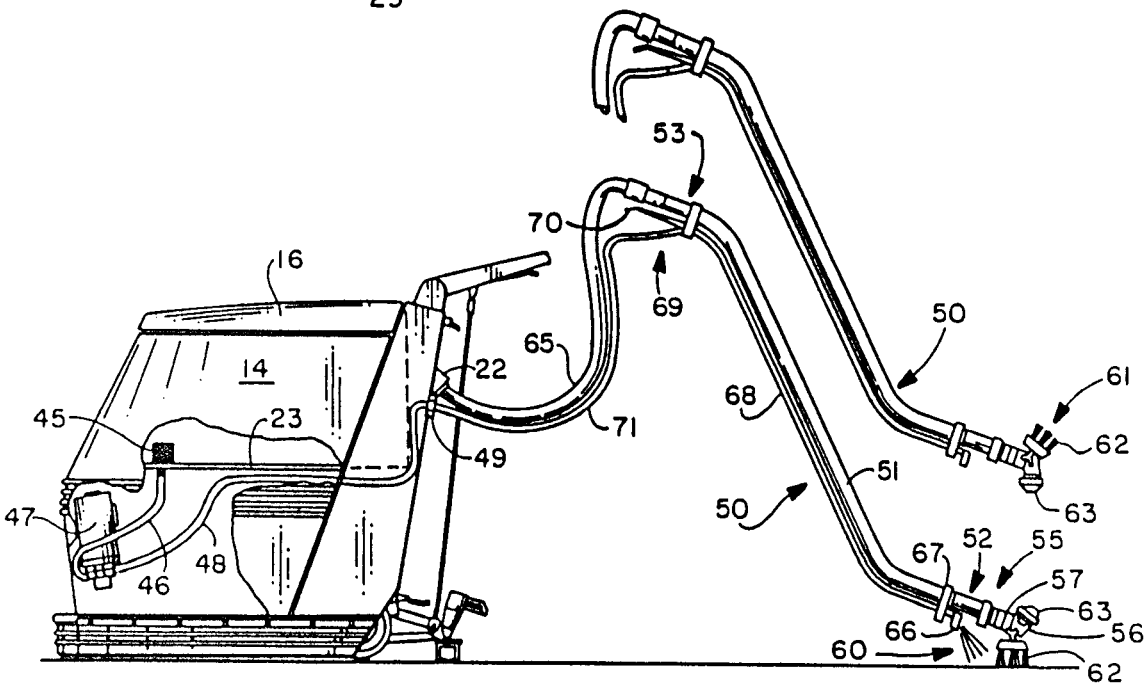
FIG. 3 is a left side view of the machine of FIG. 1 configured in the manual "scrub and recover" mode with a portion of the cover panel broken away to view the interior.

Still referring to FIG. 3, reference numeral 50 generally designates an attachment assembly referred to as a wand attachment. Wand attachment 50 is adapted to be held in the hands of an operator for manual control and manipulation. It includes a rigid tube or conduit 51 having an inlet end 52 and a connecting end 53. Attached to the inlet end 52 of the wand assembly 50 is a working tool generally designated 55. The working tool 55 is convertible between a scrubbing position and a suction or recovery position. The tool 55 includes a working head 56 which is rotatably received on a connector sleeve 57 so that the head 56 may be rotated between a scrubbing position seen at 60 in FIG. 3 and a recovery position seen at 61 in FIG. 3. To accomplish this, the rotatable working head 56 includes a brush 62 and a wet vacuum pick-up 63, which are mounted to the rotary head 56 in oppositely disposed positions. The head 56 may be rotated easily between the two use positions shown in FIG. 3 simply by grasping the rigid conduit 51 and rotating the head by hand to the desired use position.

The connecting end 53 of the tube 51 is connected to the previously identified rigid extension 22 mounted to the rear of the machine housing by means of a flexible conduit 65 so that the vacuum inside the recovery tank is communicated through the tubular extension 22, flexible conduit 65 and rigid conduit 50 of the wand assembly to the vacuum pick-up device 63. When the brush 62 is rotated to the working position, the vacuum is nevertheless communicated to the pick-up device 63 and not to the brush.

In the manual "scrub and recover" mode, cleaning solution is dispensed adjacent the brush 62 through a spray nozzle 66 which is attached by means of bracket 67 to the intake end 52 of rigid hose 51. The spray nozzle 66 is connected by means of a conduit 68 to a hand-actuated valve 69 which may be operated by a lever 70. The valve 69, in turn, is connected by means of a hose 71 to connector 49. Thus, cleaning solution is dispensed under pressure created by the pump 47 adjacent the brush in a spray pattern to wet the debris on the floor which is then loosened by scrubbing action of the brush 62. Spent solution is then collected by rotating the convertible head 56 to the recovery position seen at 61 in FIG. 3 where the dirt and debris can be sucked up through the wet pick-up device 63. The width of the manual brush 62 and the working width of the wet pick-up device 63 may be of the order of 10–12 inches, although persons skilled in the art will readily realize that the width may be greater or less depending upon the application desired. A scrub and vacuum floor tool which is convertible between a brush position and a vacuum position and which has a spray nozzle is commercially available.

It will thus be appreciated that the present invention comprises a combination of elements which overcomes many of the problems facing those charged with the maintenance of fast food restaurants. The apparatus described is self-sufficient in that it need not be plugged into a wall outlet, and may be manually transported across any floor surface. Moreover, it is not dependent upon vacuum systems installed in the walls of the restaurant. The apparatus of the invention is highly flexible and mobile, and it enables an operator to apply a cleaning solution, brush the solution to loosen dirt and debris and recover the spent solution, including the loosened dirt and debris. Moreover, the system permits this operation either in a walk-behind mode in which the hand-held wand attachment 50 is not used, or it permits the operator to use the wand attachment 50 for applying cleaning solution, brushing the solution to loosen the dirt and debris, and removing the dirt and the spent solution under vacuum pick-up, in remote or hard-to-access locations. The present apparatus is mobile and flexible enough so that it may be used to clean an entire area as part of a routine maintenance problem, or it may be taken out to clean up a single spill.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. Floor scrubbing apparatus for use either as a walk-behind scrubber or as a manually-operated scrubber comprising: a chassis having support wheels; a rotary brush carried by said chassis in a position to scrub a floor; a first motor for driving said rotary brush; first dispensing means for dispensing cleaning solution on said floor to be worked by said rotary brush; vacuum recovery means including a recovery reservoir, vacuum motor means for generating a vacuum in said reservoir, and pick-up means behind said rotary brush for recovering spent solution worked by said rotary brush in cleaning said floor and for delivering said spent solution to said recovery reservoir; and a manually-operated scrub and recovery device adapted for selective connection to said apparatus and comprising a hand-held wand adapted for maneuvering by an operator and including an elongated rigid vacuum tube having one end connectable to said recovery reservoir thereby to draw in air and solution through the other end thereof, second dispensing means for dispensing cleaning solution under pressure on said floor under manual control of said operator at a location adjacent said other end of said rigid vacuum tube, and convertible means coupled to said other end of said rigid vacuum tube for movement between first and second use positions, said convertible means including a second brush and a second vacuum recovery means communicating with said rigid vacuum tube, whereby said operator may use said apparatus without said scrub and recovery device as a walk behind floor scrubbing machine or said operator may attach said scrub and recovery device to said apparatus, dispense cleaning solution under pressure on the floor adjacent said convertible means and use said second brush in said first use position to work said solution onto said floor and then move said second vacuum recovery means to recover the spent solution and store the same in said recovery reservoir.

2. The apparatus of claim 1 wherein said first dispensing means comprises a conduit for communicating cleaning solution and dispensing the same under gravity at a location adjacent said first brush, and wherein said second dispensing means comprises a pump receiving cleaning solution for pumping said cleaning solution through a hose extending along said wand, a spray nozzle located at the end of said hose adjacent said convertible means, and a manual lever actuatable by an operator for delivering fluid under pressure from said pump to said spray nozzle.

3. The apparatus of claim 1 characterized in that said apparatus is mobile, portable and includes storage batteries for supplying power to said first motor and said vacuum motor.

4. The apparatus of claim 1 wherein said second brush and said second vacuum recovery means are mounted on a common working head, and further comprising means for rotatably mounting said working head to the distal end of said rigid vacuum tube of said wand, whereby said head may be converted between said first and second use positions by hand rotation.

5. The apparatus of claim 4 wherein said apparatus includes a solution tank for storing cleaning solution, a pump mounted to said chassis receiving cleaning solution from said solution tank and for delivering the same under pressure; a flexible hose receiving said cleaning solution under pressure from said pump; a hand-actuated valve connected to said solution hose for permitting cleaning solution to flow through said valve when actuated; a second hose connected to the outlet of said hand actuated valve for communicating fluid under pressure to a location adjacent said convertible means; and a spray nozzle mounted to said rigid vacuum tube adjacent said convertible means for spraying said cleaning solution under pressure on said floor adjacent said convertible means when said valve means is actuated by said operator.

• • • • •

UNITED STATES PATENT AND TRADEMARK OFFICE

CERTIFICATE OF CORRECTION

PATENT NO. : B1 4,893,375

DATED : March 1, 1994

INVENTOR(S) : Richard L. Girman, et al

It is certified that error appears in the above-indentified patent and that said Letters Patent is hereby corrected as shown below:

On the title page, item [73], the assignee should read as follows: Hako Minuteman, Inc., Addison, Illinois and Restaurant Technology, Inc. Oakbrook, Illinois Signed and Sealed this Thirteenth Day of September, 1994

*Attest:*

Bruce Lehman

BRUCE LEHMAN

*Attesting Officer*

*Commissioner of Patents and Trademarks*

US004893375B1

REEXAMINATION CERTIFICATE (2235th)

United States Patent [19]

[11] B1 4,893,375

Girman et al.

[45] Certificate Issued Mar. 1, 1994

[54] DUAL MODE FLOOR SCRUBBING MACHINE

[75] Inventors: Richard L. Girman, Glen Ellyn; Gary E. Palmer, Roselle; Gust G. Gotsis, Naperville; Ralph Weimer, Wheaton, all of Ill.

[73] Assignee: Restaurant Technology, Inc., Oakbrook, Ill.

Reexamination Request:
No. 90/002,833, Sep. 11, 1992

Reexamination Certificate for:

| | |
|---|---|
| Patent No.: | **4,893,375** |
| Issued: | **Jan. 16, 1990** |
| Appl. No.: | **325,559** |
| Filed: | **Mar. 17, 1989** |

[51] Int. Cl.[5] ..... A47L 7/00

[52] U.S. Cl. ..... 15/321; 15/320; 15/322; 15/328; 15/334; 15/417

[58] Field of Search ..... 15/320, 321, 322, 328, 15/334, 335, 417

[56] References Cited

U.S. PATENT DOCUMENTS

| | | | |
|---|---|---|---|
| 2,793,384 | 5/1957 | Ortega | 15/328 |
| 2,867,835 | 1/1959 | Brown et al. | 15/417 X |
| 3,029,461 | 4/1962 | Osborn | 15/417 X |
| 3,079,623 | 3/1963 | Congdon | 15/417 X |
| 4,595,420 | 6/1986 | Williams | 15/353 X |
| 4,809,397 | 3/1989 | Jacobs et al. | 15/320 |

FOREIGN PATENT DOCUMENTS

| | | | |
|---|---|---|---|
| 176696 | 4/1986 | European Pat. Off. | 15/322 |
| 0224055 | 6/1987 | European Pat. Off. . | |
| 1111899 | 5/1968 | United Kingdom . | |
| 2206478 | 1/1989 | United Kingdom | 15/322 |

OTHER PUBLICATIONS

National Super Service Co., Squeegee w/Brush, (2 pages) (date unknown).
Advance Convertible Brush/Vacuum Pick-Up with Spray Nozzle (3 pages) (date unknown).
Hako brochure "Superior Technique for Industrial Cleaning" (date unknown).
Hako Minuteman brochure, "Hakomatic B43 and B53 Battery Compact Automatic Scrub" (date unknown).
Hako Minuteman Instruction Manual for Hakomatic B43 (7406) (date unknown).

*Primary Examiner*—Chris K. Moore

[57] ABSTRACT

A portable floor scrubbing machine, which preferably is battery-powered, may operate in two distinct modes: either as a walk-behind floor scrubber or as a manually-operated, scrub-and-recover system using a floor wand having a cleaning solution dispenser and convertible brush/squeegee at the working end of the wand for use in locations with difficult access.

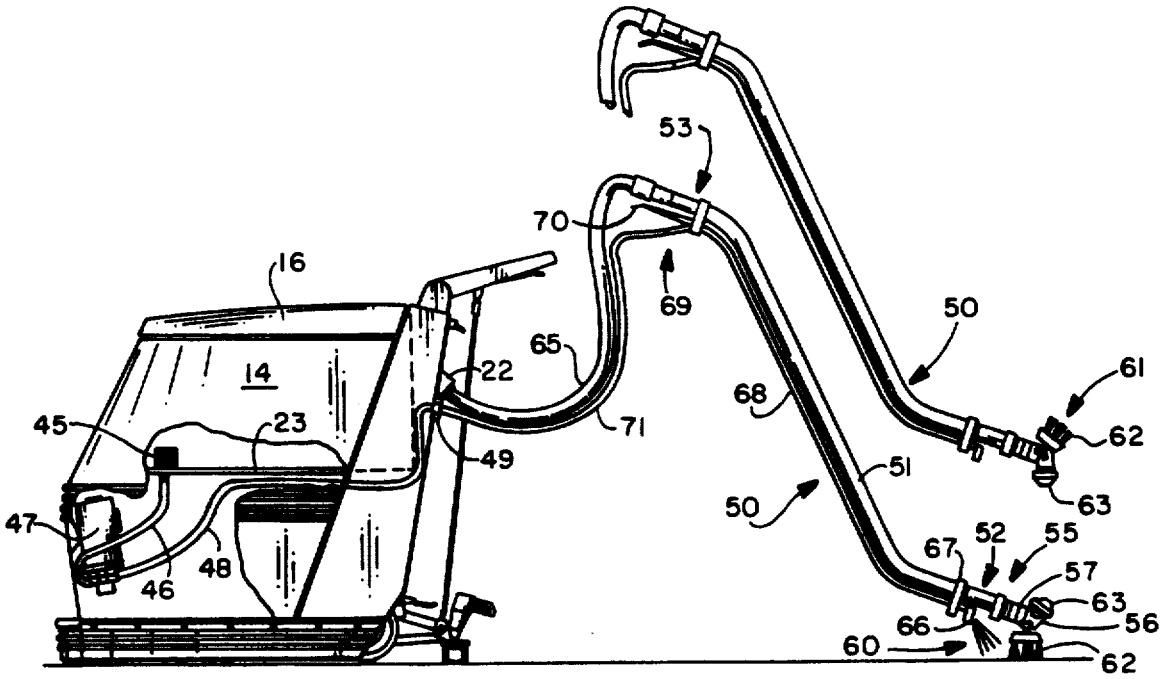

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1 and 5 are determined to be patentable as amended.

Claims 2-3 dependent on an amended claim, are determined to be patentable.

New claims 6 and 7 are added and determined to be patentable.

1. Floor scrubbing apparatus for use either as a walk-behind scrubber or as a manually-operated scrubber comprising:

a chassis having support wheels;

a rotary brush carried by said chassis in a position to scrub a floor;

a first motor for driving said rotary brush;

first dispensing means for dispensing cleaning solution on said floor to be worked by said rotary brush;

*first* vacuum recovery means including a recovery reservoir, vacuum motor means for generating a vacuum in said reservoir, and pick-up means behind said rotary brush for recovering spent solution worked by said rotary brush in cleaning said floor and for delivering said spent solution to said recovery reservoir;

and a manually-operated scrub and recovery device adapted for selective connection to said apparatus and comprising a hand-held wand adapted for maneuvering by an operator and including an elongated rigid vacuum tube having one end connectable to said recovery reservoir thereby to draw in air and solution through the other end thereof, second dispensing means for dispensing cleaning solution under pressure on said floor under manual control of said operator at a location adjacent said other end of said rigid vacuum tube,

[and] convertible means coupled to said other end of said rigid vacuum tube, [for movement between first and second use positions,] said convertible means including a *working head being adapted for rotational movement between first and second use positions, a* second brush *mounted on said working head and adapted for movement between first and second use positions said second brush being positioned to scrub the floor when said working head is positioned in said first use position,* and a second vacuum recovery means *mounted on said working head and* communicating with said rigid vacuum tube[,] *and positioned to recover spent solution from said floor under suction when said working head is positioned in said second use position, and further including means for rotatably mounting said working head to said other end of said rigid vacuum tube of said wand such that said head may be converted between said first and second use positions by hand rotation of said head about said other end of said vacuum tube,* whereby said operator may use said apparatus without said scrub and recovery device as a [walk behind] *walk-behind* floor scrubbing machine or said operator may attach said scrub and recovery device to said apparatus, dispense cleaning solution under pressure on the floor adjacent said convertible means and use said second brush in said first use position to work said solution onto said floor and then move said second vacuum recovery means to recover the spent solution and store the same in said recovery reservoir.

5. The apparatus of claim [4] *1* wherein said apparatus includes a solution tank for storing cleaning solution, a pump mounted to said chassis receiving cleaning solution from said solution tank and for delivering the same under pressure; a flexible hose receiving said cleaning solution under pressure from said pump; a hand-actuated valve connected to said solution hose for permitting cleaning solution to flow through said valve when actuated; a second hose connected to the outlet of said hand actuated valve for communicating fluid under pressure to a location adjacent said convertible means; and a spray nozzle mounted to said rigid vacuum tube adjacent said convertible means for spraying said cleaning solution under pressure on said floor adjacent said convertible means when said valve means is actuated by said operator.

*6. Floor scrubbing apparatus for use either as a walk-behind scrubber or as a manually-operated scrubber comprising:*

*a chassis having support wheels;*

*a rotary brush carried by said chassis in a position to scrub a floor;*

*a first motor for driving said rotary brush;*

*first dipensing means for dispensing cleaning solution on said floor to be worked by said rotary brush;*

*first vacuum recovery means including a recovery reservoir, vacuum motor means for generating a vacuum in said reservoir, and pick-up means behind said rotary brush for recovering spent solution worked by said rotary brush in cleaning said floor and for delivering said spent solution to said recovery reservoir;*

*and a manually-operated scrub and recovery device adapted for selective connection to said apparatus and comprising a hand-held wand adapted for maneuvering by an operator and including an elongated rigid vacuum tube having one end connectable to said recovery reservoir thereby to draw in air and solution through the other end thereof,*

*second dispensing means for dispensing cleaning solution under pressure on said floor under manual control of said operator at a location adjacent said other end of said rigid vacuum tube,*

*a working head coupled to said other end of said rigid vacuum tube including a second brush and a second vacuum recovery means communicating with said rigid vacuum tube, said second brush and said second vacuum recovery means being spaced from each other such that when said second vacuum recovery means is in a use position on the floor, said second brush is disengaged from the floor,*

*whereby said operator may use said apparatus without said scrub and recovery device as a walk-behind floor scrubbing machine or said operator may attach said scrub and recovery device to said apparatus, dispense cleaning solution under pressure on the floor adjacent said convertible means and use said second brush to work said solution onto said floor and then use said second vacuum recovery means to recover the spent solution and store the same in said recovery reservoir while said second brush is disengaged from the floor.*

*7. The apparatus of claim 6 characterized in that said second brush and said second vacuum recovery means are mounted to opposing sides of said working head, and further comprising means for rotatably mounting said working head to said other end of said rigid vacuum tube, whereby said working head may be manually rotatable on said vacuum tube to place one of said second brush and said second vacuum recovery means in operative relation with the floor while the other is disengaged from the floor.*

* * * * *